US009945396B2

(12) United States Patent
Shang et al.

(10) Patent No.: US 9,945,396 B2
(45) Date of Patent: Apr. 17, 2018

(54) FLUID SYSTEMS FOR MACHINES WITH INTEGRATED ENERGY RECOVERY CIRCUIT

(71) Applicant: Caterpillar Inc., Peoria, IL (US)

(72) Inventors: Tonglin Shang, Bolingbrook, IL (US); Aleksandar Egelja, Naperville, IL (US); Kalpesh Patel, Naperville, IL (US); Jiao Zhang, Naperville, IL (US); Pengfei Ma, Naperville, IL (US); Dayao Chen, Bolingbrook, IL (US)

(73) Assignee: Caterpillar Inc., Peoria, IL (US)

( * ) Notice: Subject to any disclaimer, the term of this patent is extended or adjusted under 35 U.S.C. 154(b) by 242 days.

(21) Appl. No.: 15/050,593

(22) Filed: Feb. 23, 2016

(65) Prior Publication Data

US 2017/0241445 A1 Aug. 24, 2017

(51) Int. Cl.

| | |
|---|---|
| ***F15B 1/027*** | (2006.01) |
| ***F15B 11/024*** | (2006.01) |
| ***F15B 1/04*** | (2006.01) |
| ***F15B 1/02*** | (2006.01) |
| ***F15B 21/14*** | (2006.01) |
| *F01P 7/04* | (2006.01) |

(52) U.S. Cl.

CPC ..... *F15B 11/024* (2013.01); *F15B 1/024* (2013.01); *F15B 1/027* (2013.01); *F15B 1/04* (2013.01); *F15B 21/14* (2013.01); *F01P 7/044* (2013.01); *F15B 2211/20569* (2013.01); *F15B 2211/20576* (2013.01); *F15B 2211/212* (2013.01); *F15B 2211/50554* (2013.01); *F15B 2211/7142* (2013.01)

(58) Field of Classification Search

CPC ..... F15B 11/024; F15B 1/04; F15B 1/024; F15B 1/027; F15B 21/14

USPC ..... 60/413

See application file for complete search history.

(56) References Cited

U.S. PATENT DOCUMENTS

| | | | | |
|---|---|---|---|---|
| 8,839,617 | B2 | 9/2014 | Nelson et al. | |
| 8,919,113 | B2 | 12/2014 | Ma et al. | |
| 8,997,476 | B2 | 4/2015 | Brinkman et al. | |
| 9,086,061 | B2 | 7/2015 | Zhang et al. | |
| 9,702,118 | B2 * | 7/2017 | Gorman | E02F 9/2225 |
| 2009/0151347 | A1 * | 6/2009 | Nagatsuka | E02F 9/2225 60/459 |
| 2012/0134848 | A1 | 5/2012 | Nelson et al. | |
| 2012/0180470 | A1 | 7/2012 | Schroeder et al. | |
| 2014/0033692 | A1 | 2/2014 | Nelson et al. | |

FOREIGN PATENT DOCUMENTS

| | | |
|---|---|---|
| WO | 2015019489 | 2/2015 |

* cited by examiner

*Primary Examiner* — F. Daniel Lopez
*Assistant Examiner* — Daniel Collins

(57) ABSTRACT

A fluid system for a machine that includes a linkage. The fluid system includes an actuator, an accumulator, a pilot circuit, and a pressure reducing valve. The actuator is configured to manipulate the linkage. The accumulator is configured to store a fluid discharged by the actuator under pressure. The pilot circuit is fluidly coupled to the accumulator and is configured to receive the fluid from the accumulator. Further, the pressure reducing valve is positioned between the accumulator and the pilot circuit to regulate the pressure of the fluid delivered to the pilot circuit from the accumulator.

20 Claims, 5 Drawing Sheets

FLUID SYSTEMS FOR MACHINES WITH INTEGRATED ENERGY RECOVERY CIRCUIT

TECHNICAL FIELD

The present disclosure relates to the field of energy recovery and reuse in fluid systems of machines. More particularly, the present disclosure relates to integrated energy recovery and reuse circuits of hydraulic systems associated with operations of linkages in machines.

BACKGROUND

Machines may be used to excavate portions of a worksite. Such machines include swing-type excavation machines, hydraulic excavators, front shovels, etc. Such machines generally include hydraulically powered implement systems or work tool assemblies that effectuate a material transfer operation. Such work tool assemblies commonly include an implement and one or more linkages, such as a boom, a stick, and/or lift arms, which may be suitably in turn powered by associated hydraulic circuits, as is customary. These circuits function in concert and require relatively significant hydraulic pressures to fulfill various parametric based operations, such as those involving raising, articulating, and lowering of loaded work tool assemblies, to execute material transfer.

One difficulty associated with conventional operations of boom circuits is related to the attainment of a minimum degree of work efficiency. More particularly, a fluid exiting one or more lift actuators of the linkages during a lowering of the loaded implement for example, may be under relatively high pressure. Unless recovered and utilized, an energy associated with this high-pressure fluid may be wasted. Although certain solutions use an accumulator to store this energy for later use, during a conversion of this energy to mechanical energy, a significant amount of energy is wasted. Therefore, room remains to improve upon this utilization.

Patent Application WO 2015019489 ('489 reference) relates to a control of a hydraulic pump that drives a fan to cool a radiator in a working vehicle. In general, the '489 reference discloses using an accumulator to drive the fan. Although the system of the '489 reference may help to improve efficiencies of the associated circuit, in some situations it may still be less than optimal.

SUMMARY OF THE INVENTION

Various aspects of the present disclosure disclose a fluid system for a machine. The machine is inclusive of a linkage. The fluid system includes an actuator, an accumulator, a pilot circuit, and a pressure reducing valve. The actuator is configured to manipulate the linkage. The accumulator is configured to store a fluid discharged by the actuator under pressure. The pilot circuit is fluidly coupled to the accumulator and is configured to receive the fluid from the accumulator. The pressure reducing valve is positioned between the accumulator and the pilot circuit to regulate the pressure of the fluid delivered to the pilot circuit from the accumulator.

Certain aspects of the present disclosure disclose a hydraulic system for a machine. The machine includes a linkage. The hydraulic system includes an actuator, a primary power source, and an energy recovery circuit. The actuator is configured to manipulate the linkage, and in turn, the primary power source is configured to fluidly power the actuator. The energy recovery circuit is configured to operate in a first mode and a second mode relative to the hydraulic system. The energy recovery circuit includes an accumulator, a pilot circuit, a fan circuit, and a secondary power source. The accumulator is configured to store a fluid discharged by the actuator under pressure. The pilot circuit is fluidly coupled to the accumulator and configured to receive the fluid from the accumulator. Further, the fan circuit is fluidly coupled to the accumulator and configured to receive the fluid from the accumulator. The secondary power source is configured to be selectively and fluidly coupled with the pilot circuit and the fan circuit. In the first mode, the accumulator is configured to fluidly power at least one of the fan circuit and the pilot circuit. In the second mode, however, the secondary power source is configured to fluidly power at least one of the fan circuit and the pilot circuit.

One aspect of the present disclosure discloses a method for recovering energy in a fluid system of a machine. The method includes storing a fluid discharged by an actuator of a linkage of the machine under pressure, in an accumulator. Further, the method includes delivering the fluid from the accumulator to a pilot circuit of the machine, to fluidly power the pilot circuit. The pressure of the fluid delivered to the pilot circuit is regulated by a pressure reducing valve.

DETAILED DESCRIPTION

Figure 1:
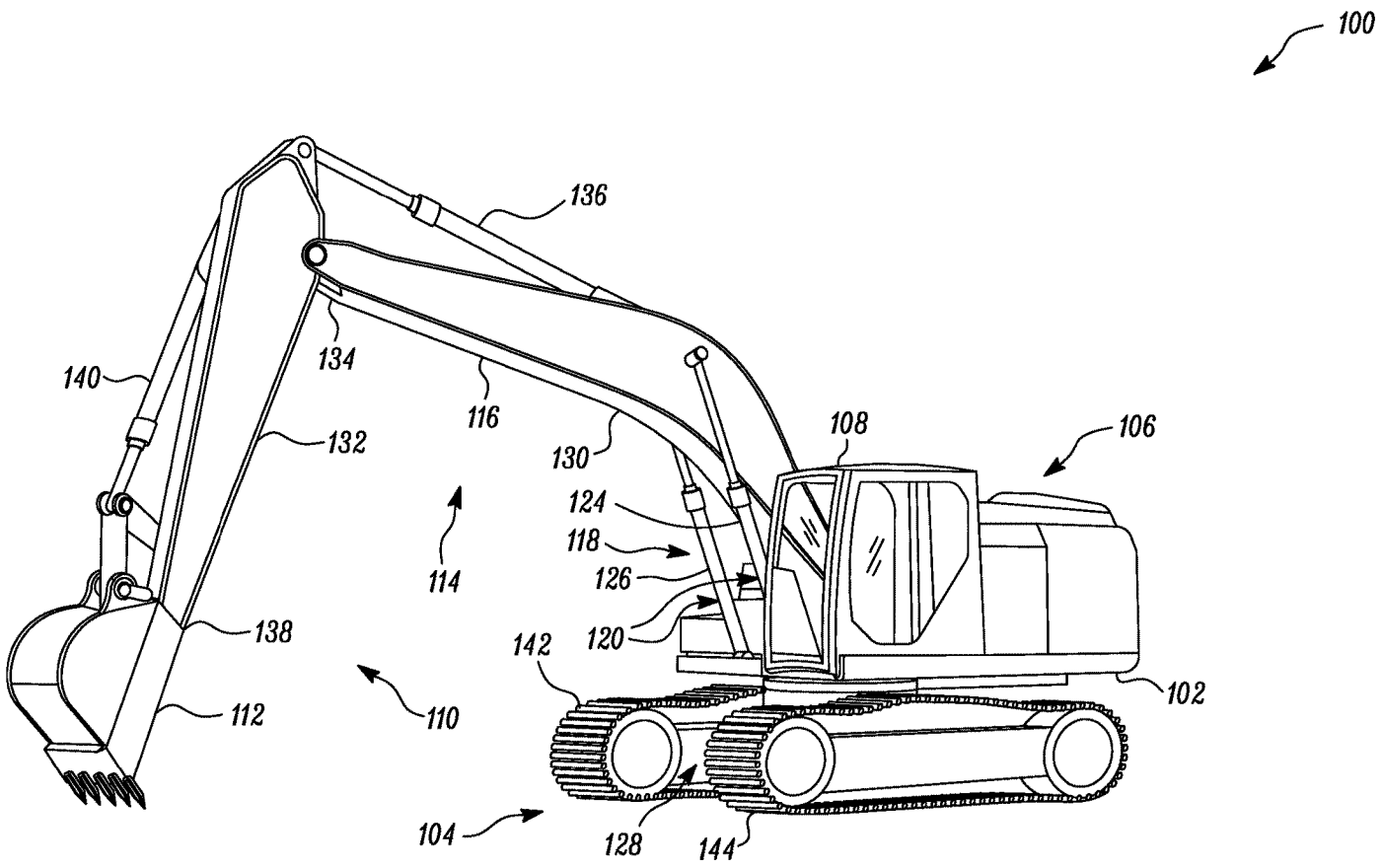
FIG. 1 is an exemplary excavation machine installed with a fluid system, in accordance with the concepts of the present disclosure.

Referring to FIG. 1, a machine 100 is shown. The machine 100 may be an excavation machine, a hydraulic excavator, or a front shovel. The machine may embody other machine types having a linkage potential energy that could be a source for energy capture and reuse. The machine 100 may incorporate multiple systems, sub-systems, and components that cooperate to excavate and load earthen material onto a dumpsite. In addition, the machine 100 embodies a tracked configuration, as shown. Alternatively, the machine 100 may embody a wheeled configuration or a combination of a tracked and a wheeled configuration, as well. The machine 100 may also represent other types of earth-working units, such as wheel loaders, backhoe loaders, dragline excavators, cranes, skid steer loaders, or similar machines, which incorporate hydraulically operated systems to perform relatively heavy duty operations, such as those involving material transfer. In one example, the hydraulically operated systems may be used for raising, lowering, and dumping a load.

Further, an applicability of the aspects of the present disclosure may also extend to vehicles and mobile units applied in various commercial and domestic establishments. Reference will now be made in detail to embodiments of the present disclosure, examples of which are illustrated in the accompanying drawings. Wherever possible, the same reference numbers will be used throughout the drawings to refer to the same or like parts.

Figure 2:
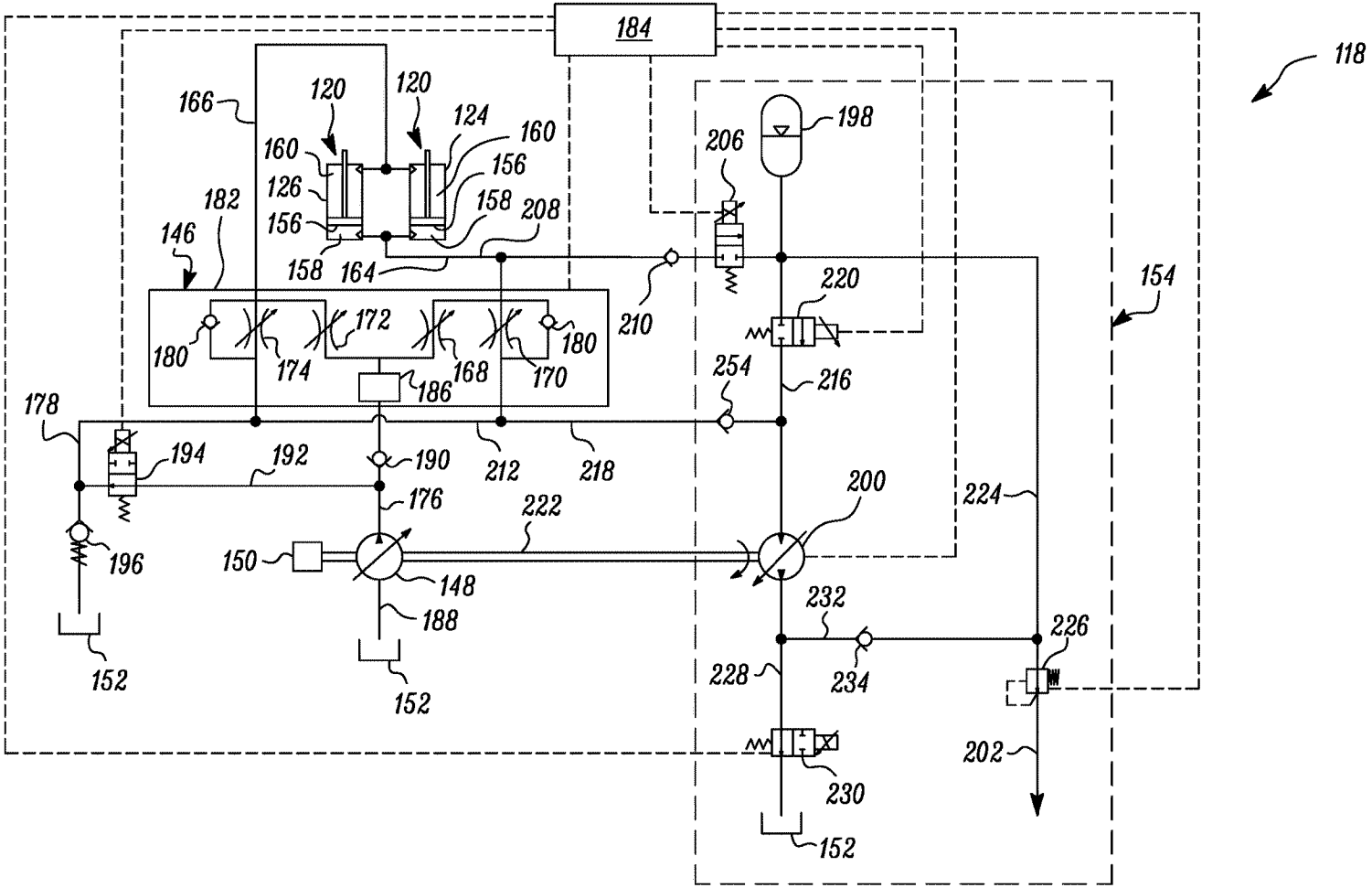
FIG. 2 is a schematic view of the fluid system incorporated within the excavation machine of FIG. 1 that includes an energy recovery circuit, in accordance with the concepts of the present disclosure.
Figure 3:
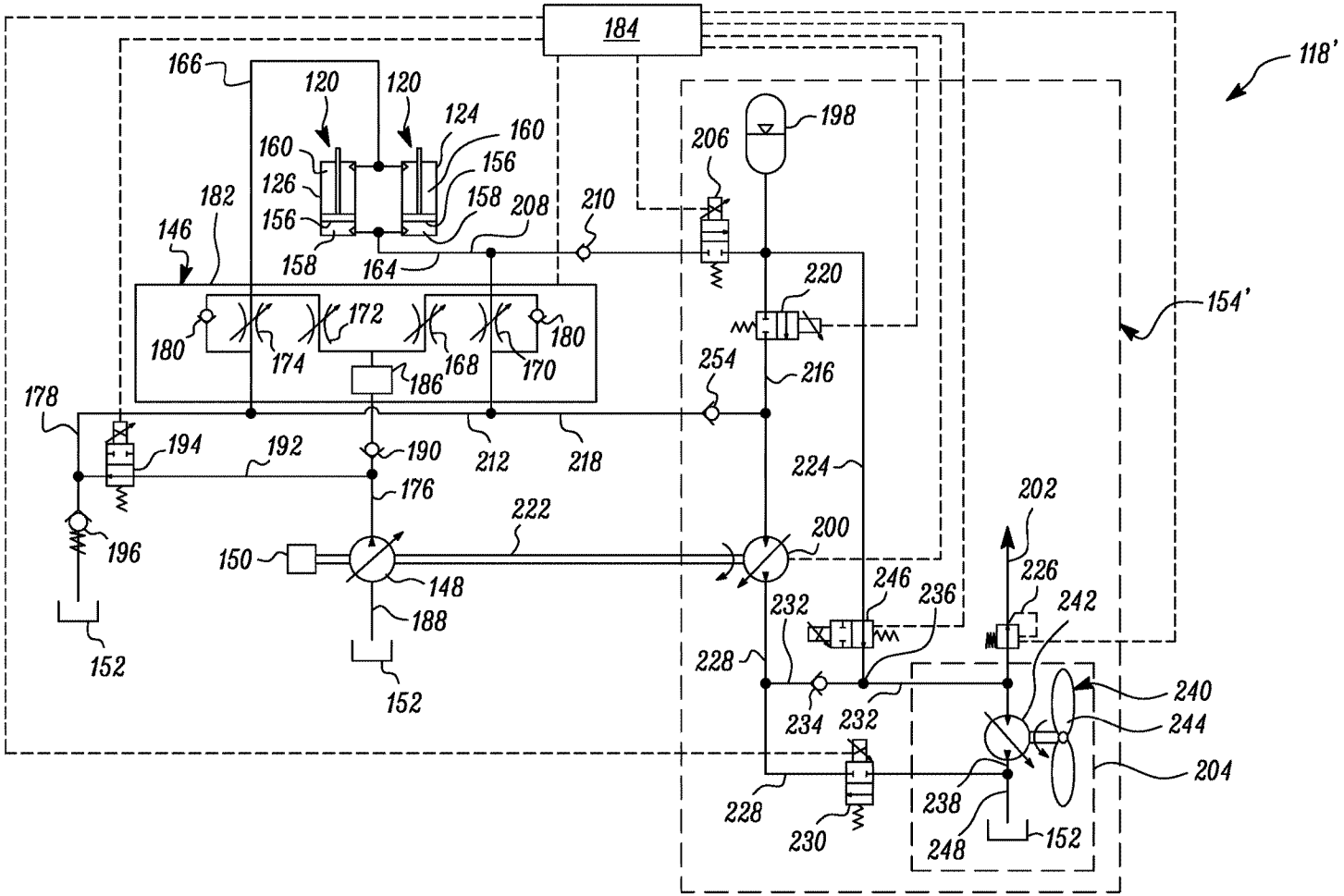
FIG. 3 is an embodiment of the energy recovery circuit incorporated with the fluid system represented in FIG. 2, in accordance with the concepts of the present disclosure.
Figure 4:
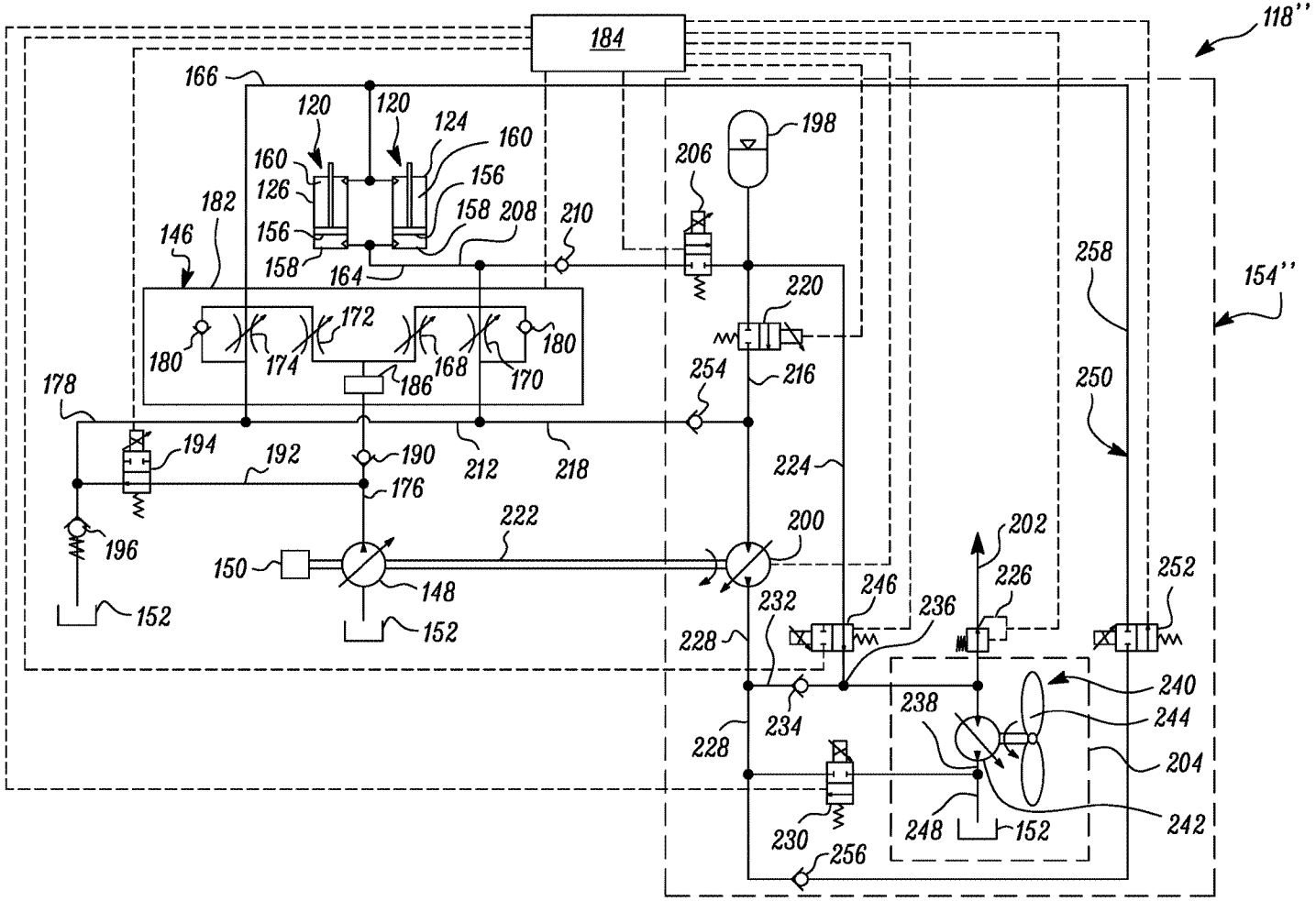
FIG. 4 is yet another embodiment of the energy recovery circuit represented in FIG. 2, in accordance with the concepts of the present disclosure.

The machine 100 includes a frame 102, one or more ground engaging traction devices 104, an engine system 106, and an operator cab 108. The machine 100 also includes a work tool assembly 110 that is further classified into an implement 112 and a linkage assembly 114. The linkage assembly 114 includes a linkage 116. In an embodiment, the linkage 116 may be one or more in number, and may represent working arms of the machine 100 capable of doing useful work. The linkage assembly 114 is configured to move the implement 112 between a dig location, such as defined by a trench site, to a pile site or a dump location. Further, the machine 100 includes a fluid system or a hydraulic system 118 (as shown in FIGS. 2, 3, and 4) that helps the machine 100 perform above noted movements, and possibly other conventional operations. The hydraulic system 118 includes a lift actuator or simply an actuator 120 to manipulate the linkage 116. The actuator 120 is categorized into a first actuator 124 and a second actuator 126, as shown. For ease in referencing and understanding, further details and working of the hydraulic system 118 will be discussed later in the forthcoming description.

The frame 102 generally forms a structural reference relative to which nearly every sub-structure and sub-system of the machine 100 is arranged. Accordingly, the frame 102 accommodates the engine system 106, the operator cab 108, and the work tool assembly 110, although multiple other known components and structures may be supported by the frame 102, as well. The frame 102 is pivotably connected to an undercarriage member 128 of the machine 100 and may be swung about a vertical axis by a swing motor (not shown), relative to the undercarriage member 128. The frame 102 plays a generally pivotal role in integrating and connecting various associated structural and functional parameters of the machine 100. The frame 102 is supported relative to the ground on the ground engaging traction devices 104.

The linkage assembly 114 is inclusive of one or more linkages, as aforementioned, and may refer to an assembly constituted by a boom 130 and a stick 132 of the machine 100. According to the aspects of the present disclosure, the boom 130 and the stick 132 are interlinked to each other and are configured to pivot about an axis, as is customary. Although not limited to the boom 130, further references to the linkage 116 in the present disclosure may be construed as being in reference to the boom 130, and, therefore, the linkage 116 and the boom 130 may be used interchangeably.

As in conventional configurations, the boom 130 is pivotably connected to the frame 102 of the machine 100, and, in turn, the stick 132 is connected to a farther end 134 of the boom 130, also in a pivotable manner to the boom 130. In an embodiment, the boom 130 is generally vertically pivotable, along a vertical plane (not shown), relative to the frame 102, as ascertained by the movement of the actuator 120. In such a case, the actuator 120 may be characterized by the first actuator 124 and the second actuator 126 being assembled as a pair of adjacently positioned, double-acting, hydraulic cylinders. Similarly, the stick 132 is also generally vertically pivotable, along the same vertical plane defined by a movement of the boom 130, relative to the frame 102. The pivotable connection may be established by an actuator characterized by a single, double-acting, hydraulic cylinder. This single, double-acting, hydraulic cylinder may be referred to as a third actuator 136.

The implement 112 may be pivotably connected to an end 138 of the stick 132, defined remotely to the frame 102 of the machine 100. To accomplish this connection, a single, double-acting, hydraulic cylinder (or a fourth actuator 140) may be operatively connected between the stick 132 and the implement 112, ensuring tiltability between the two components. The implement 112 may be one of a bucket, a fork arrangement, a blade, a crusher, a shovel, a shear, a grapple, a ripper, a dump bed, a broom, a snow blower, a propelling device, a cutting device, a grasping device, or any other task-performing device known in the art. In an embodiment, one or more of the above noted implements are attachable to the stick 132. Although contemplated to lift, swing, and tilt relative to machine 100, the implement 112 may alternatively or additionally rotate, slide, extend, open, and close, or move in another manner as known in the art.

Each of the pivotable connection disclosed above, namely, the connection of the boom 130 to the frame 102, the stick 132 to the boom 130, and the implement 112 to the stick 132, may be envisioned to be actuated hydraulically by each of the actuator 120, the third actuator 136, and the fourth actuator 140. Nevertheless, it is also contemplated that a greater or lesser number of hydraulic actuators are included within the work tool assembly 110 and connected in a manner other than those described above, to satisfy operational requirements.

The engine system 106 may embody one of the commonly applied power-generation units, such as an internal combustion engine (ICE). The engine system 106 may include a V-type engine, in-line engine, or an engine with different configurations, as is conventionally known. Although not limited, the engine system 106 may include an engine (not shown), such as a spark-ignition engine or a compression ignition engine, which may be applied in the machine 100. However, aspects of the present disclosure, need not be limited to a particular engine type. The engine system 106 is configured to drive one or more pumps associated with the hydraulic system 118. In so doing, the machine 100 is able to transfer pressurized hydraulic fluid from one portion of the hydraulic system 118 to another, such as from a storage tank to the actuator 120.

The ground engaging traction devices 104 may also be referred to as a transport mechanism of the machine 100, and may constitute a set of crawler tracks. Crawler tracks are operably connected with the undercarriage member 128 and may be configured to transport the machine 100 from one location to another. Generally, there are two crawler track units (a first crawler 142 and a second crawler 144) provided for the machine 100, with the each of the first crawler 142 and the second crawler 144 being suitably and individually provided on the respective sides of the machine 100, in a known manner. In certain implementations, the transport mechanism of the machine 100 may include wheeled units (not shown) as well. Wheeled units may be provided either in combination with the first crawler 142 and the second crawler 144 or may be present on the machine 100 as stand-alone entities. The ground engaging traction devices 104 of the machine 100 and are adapted to provide tractive force for the machine 100's movement over a ground surface or a worksite.

The operator cab 108 houses various components and controls of the machine 100 that are meant for the machine 100's movement and a control of the work tool assembly 110. The operator cab 108 is also able to accommodate one or more operators during an operation of the machine 100. The operator cab 108 may include multiple input devices, such as display units, control arms, levers, and steering mechanisms, knobs, push-pull devices, switches, pedals, and other operator input devices known in the art (not shown), which correspond to various functionalities of the machine 100, such as those extending to control aspects of the hydraulic system 118. In an example, single or multi-axis joysticks may be located proximal an operator seat (not shown). Additionally, controllers may be configured to position and/or orient the implement 112 by producing an implement position signal that is indicative of a required implement speed, acceleration, and/or deceleration, in a particular direction. Such controllers may be used to actuate associated motor or pumps associated with the actuator 120 (see FIGS. 2, 3, and 4). Further, operator seating and stationing provisions, heating ventilation and cooling (HVAC) systems, and multiple other known provisions may be included within the operator cab 108, as well.

Referring to FIG. 2, the hydraulic system 118 is schematically depicted. The hydraulic system 118 includes a hydraulic fluid circulated throughout a circuit of the hydraulic system 118. In general, the hydraulic system 118 refers to a boom circuit of the machine 100 that is configured to actuate and manipulate the work tool assembly 110 in a variety of orientations so as to carry out useful work. This boom circuit may be applicable to other hydraulic circuits and implements of the machine 100 as well. The hydraulic system 118 is inclusive of the pair of adjacently positioned, double-acting, hydraulic cylinders, referred to as the first actuator 124 and the second actuator 126, as has been referenced above, and each of which may be hydraulically based. For ease in understanding, collective references to the first actuator 124 and the second actuator 126 may be simply termed as the actuator 120, hereinafter. The hydraulic system 118 further includes a valve control unit 146 to control a fluid flow and a fluid return to and from the actuator 120. Furthermore, the hydraulic system 118 includes a pump 148 drivable by a motor 150 (or the engine system 106) and multiple valves disposed generally across the associated circuit to control and regulate a fluid flow across the hydraulic system 118, as will be elaborated further below. A tank 152 is provided to store the fluid. Additionally, the hydraulic system 118 includes an energy recovery circuit (ERC) 154 to recover energy from the hydraulic system 118 and reuse the recovered energy when appropriate.

The first actuator 124 and the second actuator 126 (actuator 120) embody hydraulic cylinders with a housing having a generally linear configuration. The hydraulic cylinders are substantially tubular in structure with a piston 156 arranged within, forming two separated pressure chambers, namely a head chamber 158 and a rod chamber 160. The head chamber 158 and the rod chamber 160 may be selectively supplied with pressurized fluid and drained of the pressurized fluid to cause the piston 156 to displace and move within the hydraulic cylinders, thereby varying an effective stroke length of actuator 120, during operations. In turn, the movement of the piston 156 facilitates lowering and raising of the boom 130. The flow rate of fluid into and out of the head chamber 158 and the rod chamber 160 may be proportional to a velocity of movement of the piston 156 within the actuator 120, while a pressure differential between the head chamber 158 and the rod chamber 160 may relate to a force imparted by the actuator 120 to manipulate the associated linkage, such as the boom 130. The expansion and retraction of the actuator 120 may function to lift and lower the boom 130 and the implement 112 relative to the frame 102 of the machine 100.

The valve control unit 146 may be connected to the actuator 120 by way of a head-end passage 164 and a rod-end passage 166, while also being fluidly connected to receive pressurized fluid from the pump 148. Based on an operating position of the valve control unit 146, one of the head-end passage 164 and the rod-end passage 166 may be fluidly connected to the pump 148 via the valve control unit 146, while the other of the head-end passage 164 and the rod-end passage 166 may be simultaneously connected to the tank 152, also via the valve control unit 146. Such a configuration facilitates creation of a pressure differential across the piston 156 within the actuator 120 and causes extension and/or retraction of the actuator 120 by regulating the fluid pressure from the pump 148. Effectively, a pressure differential may generally exist between the head chamber 158 and the rod chamber 160 during a lifting and/or a lowering movement of the implement 112.

In an example, when the implement 112 is relatively heavily loaded and has to be lifted, a pressurization of the head chamber 158 of the actuator 120 is required. That is, the head chamber 158 may be rendered in fluid communication with the pump 148 through the valve control unit 146, so as to receive the pressurized fluid from the pump 148. At the same time, it is also required to evacuate the rod chamber 160 of a fluid pressure. In such an instance, the rod chamber 160 of the actuator 120 may be fluidly connected with the tank 152 via the valve control unit 146 so as to relatively easily drain out the fluid from the rod chamber 160, and effectuate ease in the lifting process.

The valve control unit 146 may have elements that are movable to control the extension and retraction of the actuator 120 and the corresponding lifting and lowering motions of the work tool assembly 110. The valve control unit 146 may include a head-end supply element 168, a head-end drain element 170, a rod-end supply element 172, and a rod-end drain element 174, all disposed within a housing or a common block 182 of the valve control unit 146. The head-end supply element 168 and the rod-end supply element 172 is configured to regulate respective filling of the head chamber 158 and the rod chamber 160 with fluid from the pump 148 via a discharge passage 176. Similarly, the head-end drain element 170 and the rod-end drain element 174 may be configured to regulate draining of the head chamber 158 and the rod chamber 160 of fluid to the tank 152 via a return passage 178, as and when required. Generally, each of the head-end supply element 168, the head-end drain element 170, the rod-end supply element 172, and the rod-end drain element 174 are independently controlled drain and supply elements. A makeup valve 180, for example a check valve, may be disposed between the return passage 178 and an outlet of the head-end drain element 170, and between the return passage 178 and an outlet of the rod-end drain element 174.

Therefore, to extend the actuator 120 or to lift the boom 130, the head-end supply element 168 may be shifted to allow pressurized fluid from the pump 148 to enter the head chamber 158 via the discharge passage 176 and the head-end passage 164, while the rod-end drain element 174 may be shifted to allow fluid from the rod chamber 160 to drain into the tank 152 via the rod-end passage 166 and the return passage 178. Conversely, to retract the actuator 120 or to lower the boom 130, the rod-end supply element 172 may be shifted to communicate the rod chamber 160 with pressurized fluid from the pump 148, while the head-end drain element 170 may be shifted to allow for draining of fluid from the head chamber 158 into the tank 152. It is contemplated that both the supply and drain functions of the valve control unit 146 may be alternatively performed by a single valve element associated with the head chamber 158 and the rod chamber 160. In an embodiment, the head-end supply element 168, the rod-end supply element 172, the head-end drain element 170, and the rod-end drain element 174, may be solenoid-movable against a spring bias in response to a flow rate and/or position command issued by a controller 184 of the hydraulic system 118. A fluid flowing into and out of the actuator 120 generally correspond to the velocity of a movement of the piston 156 within the actuator 120, and which may be differentiated based on an operator request.

In some embodiments, the valve control unit 146 includes a pressure compensator 186. In the disclosed example, the pressure compensator 186 is disposed within the discharge passage 176 at a location upstream of the valve control unit 146. In this location, the pressure compensator 186 may be configured to supply fluid with a substantially constant flow rate and a substantially steady pressure to the valve control unit 146 to avoid boom circuit flow fluctuations that may be caused by the other functions that are part of the hydraulic system 118 of the machine 100.

Commands to perform and modulate the above operations may be provided by the controller 184 of the hydraulic system 118. The controller 184 may be connected to each of the valves of the hydraulic system 118. The controller 184 may include a memory, a secondary storage device, a timer, and one or more processors, that cooperate to accomplish a task according to the present disclosure. In an embodiment, the controller 184 may be positioned and connected to other control units of the machine 100. The controller 184 may include a set of volatile memory units such as random access memory (RAM) and read-only memory (ROM), which include associated input and output buses. The controller 184 may be configured to store multiple values of fluid pressure in such memory units. Such values may include predefined fluid pressure threshold values, maximum pressure values, etc., based on which a closure and opening of the elements (the head-end supply element 168, the head-end drain element 170, the rod-end supply element 172, and the rod-end drain element 174), for example, tallied with the other valves of the hydraulic system 118, may be performed. Moreover, the controller 184 may store similar data for valves applied in the ERC 154, as well.

In an exemplary embodiment, the controller 184 may form a portion of one of the machine 100's electronic control unit (ECU), such as a safety module or a dynamics module, or may be configured as a stand-alone entity. In certain implementations, the controller 184 may be configured into the machine's dashboard to impart functionality, accessibility, and service convenience. Further exemplary arrangements may include the controller 184's accommodation within other machine panels or portions from where the controller 184 remains accessible for ease of use, maintenance, and repairs.

The pump 148 is a primary power source of the hydraulic system 118, driven by the motor 150. The motor 150 may embody the engine of the engine system 106 (FIG. 1). The pump 148 is configured to draw fluid from the tank 152 via an inlet passage 188, pressurize the fluid to a required level, and discharge the fluid into the actuator 120 via the discharge passage 176 and the valve control unit 146. In that way, the pump 148 fluidly powers the actuator 120. The inlet passage 188 may be a low pressure passage. A first check valve 190 is disposed within the discharge passage 176 to provide for a unidirectional flow of a pressurized fluid from the pump 148 into the actuator 120. The pump 148 may embody a variable displacement pump, a fixed displacement pump, or other pump-types, as has been known and applied in the art. The pump 148 may be drivably connected to the motor 150, for example, by a countershaft (not shown), a belt (not shown), an electrical circuit (not shown), or by other suitable means. Alternatively, the pump 148 may be indirectly connected to the motor 150 via a torque converter, a reduction gear box, an electrical circuit, or in any other suitable manner. The pump 148 is configured to produce a stream of pressurized fluid having a pressure level and/or a flow rate determined by a pressure of the actuator 120, control commands of the valve control unit 146, and certain operator requested demands. A bypass passage 192 may be provided for the pump 148 with a pump bypass valve 194 in order to drain excess fluid generated by the pump 148 back to the tank 152. The pump bypass valve 194 may be applied for maintaining a minimum pump pressure and send a standby pump flow to the tank 152 through a return check valve 196.

The tank 152 may constitute a reservoir configured to hold a low-pressure supply of fluid, such as a used fluid received from the hydraulic system 118. The fluid may include, for example, a dedicated hydraulic fluid, an engine lubrication oil, a transmission lubrication oil, or any other fluid known in the art. One or more hydraulic circuits within the machine 100 may draw fluid from and return fluid to the tank 152. It is contemplated that the hydraulic system 118 may be connected to multiple fluid tanks or to a single tank. In the present disclosure, the tank 152 may be contemplated to be a single unit exemplifying appropriate space utilization in light of spatial constraints. The tank 152 may be connected to the hydraulic system 118 via low-pressure passages, such as the return passage 178, having one or more check valves (such as the return check valve 196) to promote a unidirectional flow of fluid into the tank 152 and maintain a requisite return fluid flow pressure. The tank 152 may also be connected to the hydraulic system 118 via the inlet passage 188, facilitating a connection of the tank 152 with the pump 148.

The ERC 154 is fluidly connected with the actuator 120 and is configured to selectively receive, extract, and recover energy from a pressurized fluid discharged by the actuator 120. The ERC 154 includes an accumulator 198, a secondary power source 200, a set of check valves, including a second check valve 210 and a third check valve 234, as well as a set of control valves, namely a charge valve 206, a discharge valve 220, and a motor bypass valve 230. The charge valve 206, the discharge valve 220, and the motor bypass valve 230, are used to control energy storage and reuse. In this embodiment, the ERC 154 is fluidly connected to a pilot circuit 202. In certain preferred embodiments, the ERC 154 is fluidly connected to a fan circuit 204 (FIGS. 3 and 4), as well. Both the pilot circuit 202 and the fan circuit 204 are configured to be powered by the ERC 154.

The accumulator 198 is adapted to be selectively and fluidly connected with the actuator 120 via the charge valve 206. For this purpose, a recovery passage 208 of the ERC 154 may extend from the head chamber 158 of the actuator 120 (or from the head-end passage 164) to the accumulator 198. In so doing, the accumulator 198 is chargeable by receiving and storing the pressurized fluid from the actuator 120 under pressure, during operations. The charge valve 206 is positioned on the recovery passage 208 to ensure control of a charged fluid flow into the accumulator 198. Further, the second check valve 210 may be suitably positioned on the recovery passage 208 to promote a pressurized and unidirectional fluid flow from the actuator into the accumulator 198. Further, an auxiliary passage 212 also fluidly extends from the head-end drain element 170 to the return passage 178, so as to provide a drainage path to the fluid from the head chamber 158 to the tank 152.

The accumulator 198 may embody a pressure vessel filled with a compressible gas that is configured to store pressurized fluid for future use. The compressible gas may include, for example, nitrogen, argon, helium, or other appropriate compressible gas. In such a case, as the fluid pressure in communication with the accumulator 198 exceeds a pre-charge pressure of the compressible gas within the accumulator 198, the fluid may flow into the accumulator 198 and be stored within the accumulator 198. Because the gas within the accumulator 198 is compressible, the gas may act as a spring and compress as the fluid flows into the accumulator 198. When the pressure of the fluid within the recovery passage 208 drops below the pressure of the compressible gas of the accumulator 198, the compressed gas may expand and urge the fluid stored within the accumulator 198 to exit the accumulator 198. It is contemplated that the accumulator 198 may alternatively embody a membrane/spring-biased, piston type, or bladder type accumulator.

The accumulator 198 may also store fluid pressure when engine power demand is low or when surplus power is generated within the hydraulic system 118. As an exemplary flow pattern, the controller 184 associated with the hydraulic system 118 may allow at least a portion of the fluid exiting the pump 148 to travel to the accumulator 198. This flow may occur via the valve control unit, the head-end passage, the recovery passage, the charge valve, and to finally the accumulator 198. In so doing, during situations when the primary power source (the pump 148) has insufficient capacity to adequately power the actuator 120, the high-pressure fluid collected from the pump 148 within the accumulator 198 may be discharged through the secondary power source 200 to conversely assist the engine system 106 and/or the pump 148. Given a provision of peak shaving, the engine system 106 (FIG. 1) may have a size relatively smaller than those conventionally applied as varying stages of pressure storage and discharge (and usage) of the present disclosure compensates for a sole, singularly run power source that may otherwise witness considerable wastage of a generated energy.

The secondary power source 200 may be an auxiliary pump/motor device generally configured to be selectively and fluidly driven by a fluid flow from the accumulator 198. To this end, the secondary power source 200 is fluidly connected with the accumulator 198 through a flow passage 216. The secondary power source 200 may function to convert energy stored in the form of pressurized fluid in the accumulator 198 to mechanical rotational energy. In an embodiment, the ERC 154 includes a connecting passage 218 linked between the auxiliary passage 212 and the flow passage 216, ensuring the secondary power source 200 to be fluidly connected and powered by both the pressurized flow received from the accumulator 198 through the flow passage 216 and fluid flow received from the auxiliary passage 212. A fourth check valve 254 (similar to the second check valve 210) is operably positioned on the connecting passage 218 of the ERC 154 to ensure a pressurized and unidirectional fluid flow from the auxiliary passage 212 to the secondary power source 200. Further, the discharge valve 220 is positioned within the flow passage 216 to allow for the fluid stored and maintained within the accumulator 198 to be selectively delivered to the secondary power source 200.

The secondary power source 200 may be a variable displacement hydraulic motor that is mechanically and drivingly coupled to the engine (or motor 150) of the engine system 106 (FIG. 1) via a shaft arrangement 222 for example. Alternatively, a connection of the shaft arrangement 222 may extend to the pump 148, as shown. By way of this coupling, the secondary power source 200 when driven by pressurized fluid, may mechanically assist the engine system 106 (or motor 150) and/or the pump 148 with supplementary power. Such an assistance may occur when the pump 148 has a positive displacement, or, alternatively, assist only the engine (or motor 150) when the pump 148 has a neutral displacement.

The charge valve 206 and the discharge valve 220 may be solenoid-operated, two-position (flow-blocking and flow-passing), two-way valve. The charge valve 206 and the discharge valve 220 may be movable in response to a command from the controller 184 to selectively allow fluid flow into and out of the accumulator 198. In one implementation, the charge valve 206 and the discharge valve 220 may be spring biased to ensure a default flow-blocking position, for example. Further alternatives to the charge valve 206 and the discharge valve 220, such as restriction orifices, may be contemplated.

The pilot circuit 202 is fluidly and integrally connected with the accumulator 198 to receive the pressurized fluid from the accumulator 198 via a pressure reducing valve 226 and be fluidly powered by the accumulator 198. For this purpose, a primary power passage 224 (part of the ERC 154) is connected between the accumulator 198 and the pilot circuit 202. Further, the pressure reducing valve 226 is positioned within the primary power passage 224, and between the pilot circuit 202 and the accumulator 198 so as to regulate a pressure of the fluid entering the pilot circuit 202 from the accumulator 198. As a pressure of the fluid delivered by the accumulator 198 is relatively greater than a pressure required by the pilot circuit 202, the pressure reducing valve 226 generally functions to lessen the fluid pressure before delivering the fluid to the pilot circuit 202.

The pressure reducing valve 226 may be a mechanical based valve element configured to control a fluid pressure delivered to the pilot circuit 202 according to a pre-set value. In certain embodiments, however, the pressure reducing valve 226 may determine pressure requirements of the pilot circuit 202 based on a controller input, and, therefore, the pressure reducing valve 226 may be configured to receive instructions from the controller 184.

In this implementation, a drain line 228 fluidly extends from the secondary power source 200, to allow the fluid pressure being received from the accumulator 198 to be relieved into the tank 152 via the motor bypass valve 230, during normal accumulator working conditions. A secondary power passage 232 fluidly extends from a portion upstream of the motor bypass valve 230 on the drain line 228 to a portion upstream of the pressure reducing valve 226 on the primary power passage 224. In that manner, the secondary power source 200 is selectively and fluidly coupled to the pilot circuit 202. If an output fluid pressure of the accumulator 198 falls below a predefined fluid pressure threshold, the secondary power source 200 may work as a supplementary power source for the pilot circuit 202. Such a switchable functionality and logic control may be ensured by the controller 184. Further, the third check valve 234 is provided on the secondary power passage 232 to ensure that a unidirectional fluid flow is enabled from the secondary power source 200 to the pressure reducing valve 226.

In an embodiment, the pilot circuit 202 may include a plurality of pilot valves (not shown) that supply a pilot oil (pressurized fluid from the accumulator 198) with control, to control a plurality of hydraulic directional control valves in various sub-hydraulic systems of the machine 100. Such valves may cause the movement of various other actuators of the machine 100, in turn apportioning requirements related to various operational parameters of different implements of the machine 100.

Referring to FIG. 3, there is shown a hydraulic system 118'. The hydraulic system 118' is similar to the hydraulic system 118 and includes an ERC 154'. The ERC 154' is generally an extension of the ERC 154, having the fan circuit 204 incorporated alongside the pilot circuit 202. The fan circuit 204 is fluidly connected with the accumulator 198 as well. In this implementation, the secondary power passage 232 is extended from the drain line 228 of the secondary power source 200 and is fluidly diverted into both the pilot circuit 202 and the fan circuit 204. The primary power passage 224 from the accumulator 198 is fluidly connected to a portion of the secondary power passage 232 referred to as an intermediate point 236, and is further fluidly directed by the secondary power passage 232 to be diverted into twin flow lines leading to the pilot circuit 202 and the fan circuit 204, as shown. The third check valve 234 may be positioned on the secondary power passage 232 upstream to the intermediate point 236 so as to enable unidirectional fluid delivery of fluid pressure from the secondary power source 200 to both the fan circuit 204 and the pilot circuit 202. In addition, the third check valve 234 prevents a flow from the accumulator 198 to be drained to tank 152 through the motor bypass valve 230. In this configuration, the drain line 228 extends further to connect to a drain port 238 of the fan circuit 204, to allow a fluid pressure to be relieved into the tank 152, via the motor bypass valve 230, which is applicable under normal accumulator working conditions.

The fan circuit 204 may include a fan unit 240 with a variable fan motor 242 and a fan 244. The variable fan motor 242 may be configured to drive and control a speed of the fan 244. The variable fan motor 242 may be driven by a fluid flow delivered by the accumulator 198 through a combined fluid channel formed by the primary power passage 224 and the secondary power passage 232. In so doing, the variable fan motor 242 is adapted to convert the associated fluid flow energy into rotational energy of the fan unit 240. A fan speed may be controlled by changing a displacement of the variable fan motor 242.

The fan unit 240 may be used in a cooling system of the machine 100, such as for cooling one or more air-to-air or liquid-to-air heat exchangers. As with the pilot circuit 202, the fan circuit 204 is also configured to be primarily powered by the accumulator 198. However, if an output fluid pressure of the accumulator 198 falls below a predefined fluid pressure threshold, the secondary power source 200 may provide supplementary fluid power through the secondary power passage 232 to drive the fan unit 240 (or the fan circuit 204) and the pilot circuit 202. As with the switchable functionality of the ERC 154 that allows the secondary power source 200 to work as a backup power source for the accumulator 198, the controller 184 applied in the ERC 154' may include a similar logic as well. Such logic enables the secondary power source 200 to act as a primary power supplier for the pilot circuit 202 and the fan circuit 204 if the output fluid pressure of the accumulator 198 falls below a predefined fluid pressure threshold. To this end, the primary power passage 224 includes a fan control valve 246 positioned on the primary power passage 224 and between the fan circuit 204 and the accumulator 198.

The fan control valve 246 is configured to control a flow and pressure of fluid passing from the accumulator 198 through an integrated circuit of the ERC 154' to both the pilot circuit 202 and the fan circuit 204. This arrangement is to selectively power and control the fan 244. In the event of the accumulator 198 falling short of a predefined fluid pressure threshold, the fan control valve 246 may be closed and the fan unit 240 may be solely powered by the secondary power source 200. Notably, the fan control valve 246 is positioned upstream of the pressure reducing valve 226. In some embodiments, the engine system 106 (or motor 150) may selectively drive the secondary power source 200 to increase a pressure of the fluid directed through the secondary power source 200 and charge the accumulator 198 through the fan control valve 246.

In an embodiment, the predefined fluid pressure threshold of the accumulator 198 may be different when only the pilot circuit 202 is fluidly coupled to the accumulator 198, than when both the pilot circuit 202 and the fan circuit 204 are fluidly coupled to the accumulator 198. Therefore, in different configurations of the ERC 154 and the ERC 154', disclosed in FIGS. 2 and 3, the controller 184 may store different values of the predefined fluid pressure threshold, and accordingly control operations of the secondary power source 200. Moreover, the controller 184 may include logic controls that determine a requirement to change the source of power from the accumulator 198 to the secondary power source 200. This is possible by having a pilot circuit control logic and a fan control logic installed into the controller 184.

Additionally, an outflow passage 248 of fluid from the variable fan motor 242 may be fluidly coupled to the drain line 228 extending from the secondary power source 200. This fluid coupling may be defined at a portion downstream to the motor bypass valve 230, and then be routed to the tank 152. As with the pilot circuit 202, the secondary power source 200 is also configured to be selectively and fluidly coupled to the fan circuit 204. Therefore, under normal operating conditions, the fan circuit 204 may be solely powered by the accumulator 198. However, during an insufficient accumulator pressure, the fan control valve 246 and the motor bypass valve 230 are closed to contain fluid pressure within the accumulator 198, while a fluid power is delivered to the variable fan motor 242 solely through the secondary power source 200.

Referring to FIG. 4, a hydraulic system 118" is shown. The hydraulic system 118" is similar to the hydraulic system 118' and envisages an ERC 154" similar to the ERC 154'. In this implementation, the ERC 154" envisions the fan circuit 204 and the pilot circuit 202 of FIG. 3, to be further integrated with a regenerative circuit 250. The regenerative circuit 250 includes a regenerative passage 258 that is selectively and fluidly connected between the drain line 228 (or more suitably from the secondary power passage 232) and the rod chamber 160 of the actuator 120. In so doing, the regenerative circuit 250 facilitates provision of an additional fluid power delivery to the actuator 120 through the secondary power source 200. With this fluid connection, the boom 130 (FIG. 1) may be assisted by the secondary power source 200 to execute a return stroke (i.e. from a previously raised position to a lowered position, for example) and corresponding to which the piston 156 may transition from a rod-end (corresponding the rod chamber 160) of the actuator 120 to a head-end (corresponding the head chamber 158) of the actuator 120.

The regenerative circuit 250 includes a regeneration valve 252 and a fifth check valve 256 (similar to the second check valve 210). The fifth check valve 256 is positioned upstream to the regeneration valve 252 on the regenerative passage 258 to provide a unidirectional flow of a pressurized fluid from the secondary power source 200 to the actuator 120. The regeneration valve 252 may be a two-position, two-way valve, which may be selectively closed or opened to a fluid flow depending upon a position of the piston 156 in the actuator 120 and an actual requirement to move the piston 156.

In certain embodiments, an opening and a closure of the regeneration valve 252 may be dependent upon the pressure being exerted against the piston 156 to execute a stroke, such as a return stroke. In one example, upon a requirement to position the piston 156 within the actuator 120 from the rod-end to the head-end, the regeneration valve 252 may be opened and fluid from the secondary power source 200 may be pumped under pressure to the rod chamber 160 to exert pressure on the piston 156 to accomplish the return stroke. It may be contemplated that a working of each of the valves—the pump bypass valve 194, the charge valve 206, the discharge valve 220, the motor bypass valve 230, the fan control valve 246, and the regeneration valve 252, is controlled by the controller 184.

Figure 5:
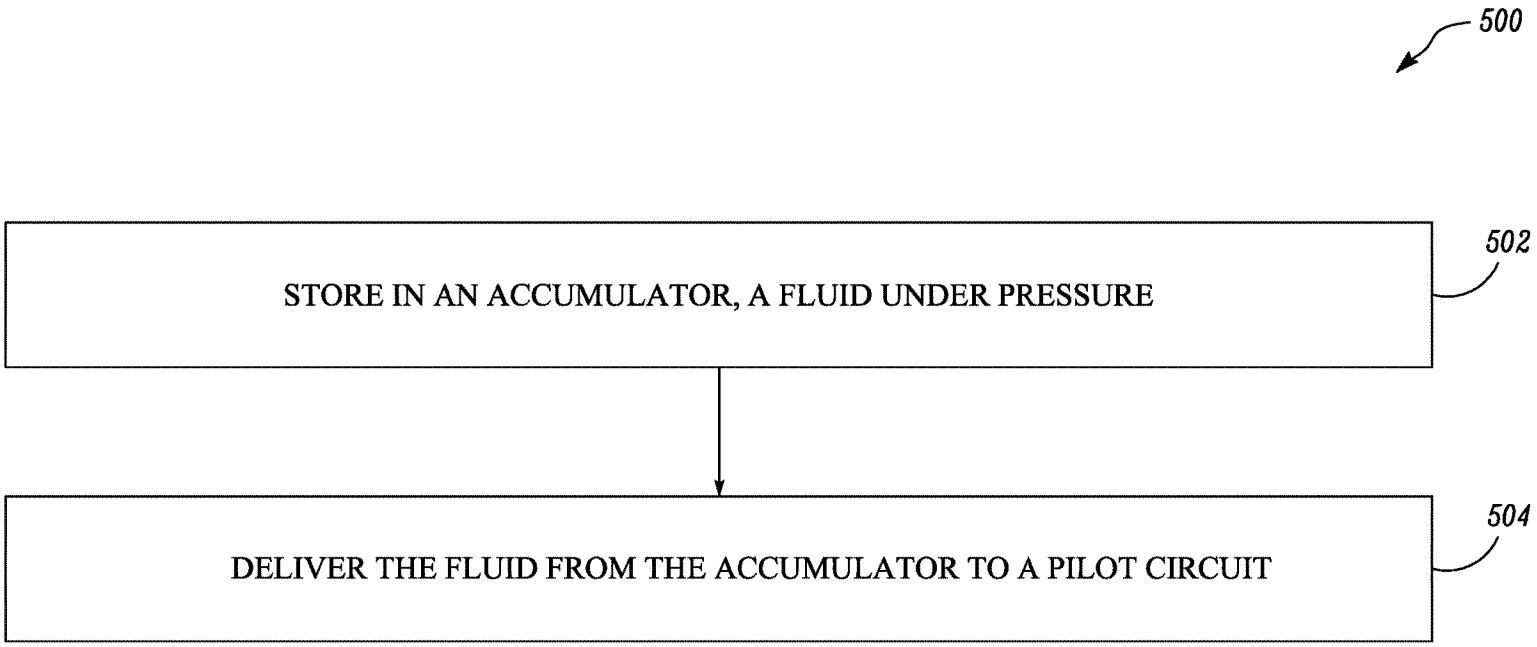
FIG. 5 is a flow chart illustrating an exemplary method for recovering energy in the energy recovery system, in accordance with the concepts of the present disclosure.

Referring to FIG. 5, there is shown a flowchart 500 depicting an exemplary method of recovering energy in the hydraulic system 118, 118',118" of the machine 100. The method is discussed in connection with FIGS. 2, 3, and 4. The method initiates at stage 502.

At stage 502, a manipulation of the actuator 120, such as during a lowering of the implement 112, enables the actuator 120 to discharge fluid housed within the head chamber 158. This fluid is drained to the tank 152. However, a provision of the recovery passage 208 facilitates routing of at least a portion of this fluid to the accumulator 198. The fluid received by the accumulator 198 is stored under pressure. The method proceeds to stage 504.

At stage 504, the accumulator 198 delivers the fluid under pressure to fluidly power the pilot circuit 202. The pressure reducing valve 226 regulates (or works to decrease) the fluid pressure received from the accumulator 198 to suit pressure requirements of the pilot circuit 202. The method ends at stage 504.

INDUSTRIAL APPLICABILITY

During operation, the hydraulic system 118, 118', 118" provides energy to displace the actuator 120, which in turn assists in the manipulation of the boom 130 relative to the frame 102. More often than not, energy provided by the hydraulic system 118, 118', 118" is surplus, and there is an increased chance for the surplus energy to be wasted. To implement a work efficient operational practice, at least a portion of this wasted energy is stored and recovered as potential energy for future use. For this purpose, the ERC 154, 154', 154" is integrated within the hydraulic system 118, 118', 118" that enables a storage and recovery of such energy, and facilitates selective powering of the pilot circuit 202 and the fan circuit 204 by the recovered energy.

During an uplift operation, such as by moving the piston 156 within the actuator 120 from the head-end to the rod-end (respectively corresponding to the ends defined by the head chamber 158 and the rod chamber 160), an operator powers the engine system 106 to drive the pump 148. As a result, and as facilitated by the valve control unit 146, the pump 148 pumps the fluid from the tank 152 to the head chamber 158 of the actuator 120. This pumping action is directed through the discharge passage 176, the head-end supply element 168, and the head-end passage 164, all the way to the head chamber 158 of the actuator 120.

As the fluid pressure from the head-end passage 164 is delivered to the head chamber 158, the fluid exerts pressure on the piston 156 within the actuator 120, pushing an amount of fluid housed within the rod chamber 160 of the actuator 120 out through the rod-end passage 166. This fluid, pushed out through the rod-end passage 166, is further drained out through the rod-end drain element 174 of the valve control unit 146. Thereafter, the fluid drains into the return passage 178 and eventually flows out into the tank 152 through the return check valve 196.

During a lowering operation of the boom 130, such as when returning the piston 156 within the actuator 120 from the rod-end to the head-end (respectively corresponding to a direction envisioned across the piston 156, directed from the rod chamber 160 to the head chamber 158), the pump 148 supplies fluid to the rod-end supply element 172 of the valve control unit 146. The rod-end supply element 172 further directs the pressurized fluid to the rod chamber 160 of the actuator 120 through the rod-end passage 166. A pressurized fluid entering the rod chamber 160 of the actuator 120 exerts pressure on the piston 156, pushing the piston 156 from the rod-end towards the head-end. Simultaneously, the piston 156 pushes out the fluid from the head chamber 158 through the head-end passage 164, the head-end drain element 170, all the way to the return passage 178, and then to the tank 152 through the return check valve 196. In certain implementations, a lowering of the boom 130 may start to occur under a weight of the linkage 116 and the implement 112 as soon as the controller 184 facilitates opening of the head-end drain element 170. A fluid exiting the head chamber 158 possesses a relatively very high pressure as compared to the pressure of a relieving fluid from the rod chamber 160 during the uplift operation.

As the recovery passage 208 is fluidly connected to the head-end passage 164, the recovery passage 208 facilitates transfer of a surplus fluid pressure into the accumulator 198 from the actuator 120 via the second check valve 210 and the charge valve 206—the controller 184 switching the charge valve 206 to an open position based on a sensed pressure (such as through suitably positioned sensors) of the head-end passage 164. Consequently, the accumulator 198 stores a portion of the fluid under pressure received during the lowering operation of the boom 130. Nevertheless, embodiments may be contemplated when pressure is stored in the accumulator 198 during the uplift operation as well. In that way, an amount of fluid pressure is stored within the accumulator 198.

The stored pressure in the accumulator 198 may be discharged through the discharge valve 220 and the secondary power source 200 at any time. The fan circuit 204 and the pilot circuit 202 use the fluid pressure stored within the accumulator 198 as the main source of power for the pilot circuit 202 and the fan circuit 204, during normal operations. In such a case, the controller 184 maintains the motor bypass valve 230 in the open state to allow a fluid driving the secondary power source 200 to be drained into the tank 152. If an accumulator pressure recedes below a predefined fluid pressure threshold, such as falling below a minimum pressure value, the controller 184 triggers a closure of the motor bypass valve 230 so that the secondary power source 200 may provide fluid flow to the pilot circuit 202 and the fan circuit 204, and charge the accumulator 198. In some embodiments, the controller 184 also configures the closure of the fan control valve 246, allowing the secondary power source 200 to be the sole source to fluidly power the fan circuit 204 and the pilot circuit 202.

A running condition of the fan unit 240, such as a speed of the fan 244, may be decided by the variable fan motor 242. Optionally, when there is a demand for the fan unit 240 to run at higher speeds, the secondary power source 200 may act as a boost pump, sourcing additional energy from the engine system 106 (FIG. 1) to service the high power requirements of the fan unit 240. If accumulator pressure is low (such as in a bottom out condition), the controller 184 closes the motor bypass valve 230 to contain a pressure received from the secondary power source 200, and so that the fan circuit 204 and the pilot circuit 202 may be suitably powered.

Further, the selective fluid connection between varying power sources (the accumulator 198 and the secondary power source 200) of the hydraulic system 118', 118" with the pilot circuit 202 and the fan circuit 204, enables the ERC 154', 154" to operate in twin modes. The first mode corresponds to the ERC 154', 154" working under an accumulator mode, while the second mode corresponds to a secondary power source mode (or pump mode). In the first mode, the accumulator 198 is configured to fluidly power at least one of the pilot circuit 202 and the fan circuit 204, while in the second mode, the secondary power source 200 is configured to fluidly power at least one of the pilot circuit 202 and the fan circuit 204.

In the accumulator mode, if peak shaving is required, or during machine start (when the accumulator 198 is discharged), the controller 184 signals the fan control valve 246 to be opened and the motor bypass valve 230 to be closed. This logic ensures that the fan circuit 204 and the pilot circuit 202 start functioning generally immediately upon machine start even if there is limited fluid pressure available from the accumulator 198. Once the boom 130 is lifted, and in order to charge the accumulator 198, the controller 184 signals the charge valve 206 to be opened, while the discharge valve 220 to be closed, so as to receive the pressurized fluid from the actuator 120. Conversely, the controller 184 signals both the discharge valve 220 and the charge valve 206 to be closed when the accumulator 198 is to be discharged through the primary power passage 224, and the fan control valve 246, to power the fan circuit 204 and/or the pilot circuit 202. The closure of the both the charge valve 206 and the discharge valve 220 may correspond to a neutral mode of operation of the fan circuit 204.

In an accumulator mode, and under a normal operational mode, the controller 184 signals both the fan control valve 246 and the motor bypass valve 230 to be opened. To charge the accumulator 198, the controller 184 signals the charge valve 206 to be maintained open, while the discharge valve 220 may be either of opened or closed. To discharge the accumulator 198, the controller 184 signals the charge valve 206 to be closed and the discharge valve 220 to be opened, powering both the secondary power source 200 via the flow passage 216 and the fan circuit 204 and/or the pilot circuit 202 through the primary power passage 224. In the neutral mode of operation of the fan circuit 204, the controller 184 signals both the charge valve 206 and the discharge valve 220 to be closed.

In the pump mode, and under the requirement to have a relatively high fan speed, the controller 184 signals the fan control valve 246 and the motor bypass valve 230 to be closed. To charge the accumulator 198, the controller 184 signals an opening of the charge valve 206 and either of an opening or a closure of the discharge valve 220. Conversely, to accommodate a discharge of the accumulator 198, the controller 184 signals a closure of the charge valve 206 and an opening of the discharge valve 220. In a neutral mode of operation, the controller 184 signals both the charge valve 206 and the discharge valve 220 closed, allowing the fan circuit 204 and/or the pilot circuit 202 to be driven by the secondary power source 200 alone.

Given the twin modes of operation of the present disclosure, a considerable portion of the unused energy is utilized by the pilot circuit 202 and the fan circuit 204, thereby enhancing efficiency. Moreover, by fluidly connecting and powering the pilot circuit 202 and the fan circuit 204 to the ERC 154', 154" a substantial amount of conversion losses associated with the otherwise conventional fan circuits and pilot circuits connected to the secondary power source 200 via mechanically linkages, is effectively avoided.

For a boom lowering event, and to save energy of the pump 148, the regenerative circuit 250 allows fluid pressure from the head-end of the actuator 120 to flow to the rod-end of the actuator 120 through the regeneration valve 252. To accomplish this flow, the controller 184 maintains the regeneration valve 252 in the open state. Further, the regenerative circuit 250 may also lead to a reduction in the accumulator size. This is because a captured energy is being readily recirculated back into the hydraulic system 118", postulating a generally lessened storage space for the captured energy, and thereby the accumulator 198.

The hydraulic system 118, 118', 118" is formed by fluidly connecting at least one of the pilot circuit 202 and the fan circuit 204 with the accumulator 198. In some embodiments, the ERC 154', 154" may also exclusively employ the fan circuit 204 with the accumulator 198, independent of the pilot circuit 202. As the accumulator 198 recovers potential energy generated during a displacement of the boom 130 (or the actuator 120), the recovered potential energy is readily available for conversion to mechanical energy, as required by the fan circuit 204 and a hydraulic energy required by the pilot circuit 202. This energy conversion occurs without any intermediate energy conversion processes, thereby mitigating conversion losses. In effect, an efficiency associated with energy recovery in hydraulic system 118, 118', 118" is enhanced, while a cost may be reduced.

It should be understood that the above description is intended for illustrative purposes only and is not intended to limit the scope of the present disclosure in any way. Thus, one skilled in the art will appreciate that other aspects of the disclosure may be obtained from a study of the drawings, the disclosure, and the appended claim.

What is claimed is:

1. A fluid system for a machine, the machine including a linkage, the fluid system comprising:

an actuator configured to manipulate the linkage;

an accumulator configured to store, under pressure, a fluid discharged by the actuator;

a pilot circuit fluidly coupled to the accumulator, and configured to receive the fluid from the accumulator; and a pressure reducing valve positioned between the accumulator and the pilot circuit to regulate the pressure of the fluid delivered to the pilot circuit from the accumulator.

2. The fluid system of claim 1, wherein the linkage comprises at least one of a boom or a stick.

3. The fluid system of claim 1 further comprising a primary power source configured to fluidly power the actuator.

4. The fluid system of claim 1 further comprising a secondary power source configured to be fluidly powered by the accumulator, the secondary power source configured to be selectively and fluidly coupled to the pilot circuit.

5. The fluid system of claim 4 further comprising a regenerative circuit for selectively and fluidly coupling the secondary power source to the actuator.

6. The fluid system of claim 4 further comprising a fan circuit including a fan unit, the fan circuit fluidly coupled to the accumulator and configured to receive the fluid from the accumulator.

7. The fluid system of claim 6 further comprising a fan control valve positioned between the fan circuit and the accumulator and upstream of the pressure reducing valve.

8. The fluid system of claim 6, wherein the secondary power source is configured to be selectively and fluidly coupled to the fan circuit.

9. A hydraulic system for a machine, the machine including a linkage, the hydraulic system comprising:

an actuator configured to manipulate the linkage;

a primary power source configured to fluidly power the actuator;

an energy recovery circuit configured to operate in a first mode and a second mode, the energy recovery circuit including:

an accumulator configured to store under pressure a fluid discharged by the actuator;

a pilot circuit fluidly coupled to the accumulator and configured to receive the fluid from the accumulator;

a fan circuit fluidly coupled to the accumulator and configured to receive the fluid from the accumulator; and a secondary power source configured to be selectively and fluidly coupled with the pilot circuit and the fan circuit, wherein in the first mode, the accumulator is configured to fluidly power at least one of the fan circuit and the pilot circuit, and in the second mode, the secondary power source is configured to fluidly power at least one of the fan circuit and the pilot circuit.

10. The hydraulic system of claim 9, wherein the linkage is one of a boom or a stick.

11. The hydraulic system of claim 9 further comprising a pressure reducing valve positioned between the accumulator and the pilot circuit to regulate the pressure of the fluid delivered to the pilot circuit from the accumulator.

12. The hydraulic system of claim 11 further comprising a fan control valve positioned between the fan circuit and the accumulator and upstream of the pressure reducing valve, the fan control valve configured to regulate the pressure of the fluid delivered to the fan circuit from the accumulator.

13. The hydraulic system of claim 9 further comprising a regenerative circuit that selectively and fluidly couples the secondary power source to the actuator.

14. The hydraulic system of claim 9, wherein the secondary power source is drivingly coupled to the primary power source and configured to be selectively and fluidly coupled with the accumulator.

15. A method for recovering energy in a fluid system of a machine, the method comprising:

storing in an accumulator, a fluid under pressure, the fluid being discharged by an actuator of a linkage of the machine; and delivering the fluid from the accumulator to a pilot circuit of the machine to fluidly power the pilot circuit, the pressure of the fluid delivered to the pilot circuit being regulated by a pressure reducing valve.

16. The method of claim 15 further comprising fluidly powering the pilot circuit by a secondary power source if an output fluid pressure of the accumulator falls below a predefined fluid pressure threshold.

17. The method of claim 15 further comprising delivering the fluid from the accumulator to a fan circuit of the machine to fluidly power the fan circuit.

18. The method of claim 17 further comprising regulating delivery of the fluid from the accumulator to the fan circuit by a fan control valve.

19. The method of claim 17 further comprising fluidly powering the fan circuit by a secondary power source if an output fluid pressure of the accumulator falls below a predefined fluid pressure threshold.

20. The method of claim 19 further comprising delivering the fluid from the secondary power source to the actuator by a regenerative circuit.

* * * * *